United States Patent [19]

Kukolj

[11] Patent Number: 4,819,547

[45] Date of Patent: Apr. 11, 1989

[54] AXIALLY CONTRACTABLE ACTUATOR

[76] Inventor: Mirko Kukolj, 5490 Braelawn Drive, Burnaby, British Columbia, Canada, V5B 4R7

[21] Appl. No.: 172,764

[22] Filed: Mar. 28, 1988

[51] Int. Cl.[4] ..... F01B 19/00

[52] U.S. Cl. ..... 92/261; 92/92; 92/153

[58] Field of Search ..... 92/89, 90, 91, 92, 153

[56] References Cited

U.S. PATENT DOCUMENTS

| | | | |
|---|---|---|---|
| 2,642,091 | 6/1953 | Morin | 92/90 |
| 2,844,126 | 7/1958 | Gaylord | 92/90 |
| 3,645,173 | 2/1972 | Yarlott | 92/92 |
| 4,189,985 | 2/1980 | Harris | 92/153 |
| 4,527,464 | 7/1985 | Frey | 92/153 X |

*Primary Examiner*—Edward K. Look

*Attorney, Agent, or Firm*—Shlesinger & Myers

[57] ABSTRACT

An actuator has a first connection point and a second connection point at opposite ends and is contractable along an axis extending between the connection points. The actuator has at least one hollow enclosure with an opening for admitting a pressurized fluid. A simultaneously radially expandable, axially contractable constraining means cooperates with the enclosure. The constraining means converts radial expansion of the actuator into axial contraction when pressurized fluid is admitted into the enclosure. In a preferred form, the constraining means comprises a network of non-stretchable, flexible tension links.

18 Claims, 6 Drawing Sheets

FIG. 11
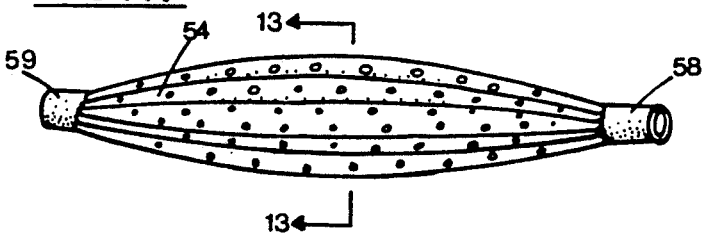
FIG. 12
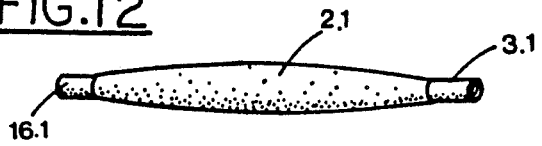
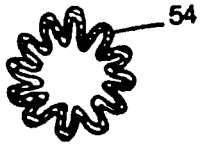
FIG. 13

AXIALLY CONTRACTABLE ACTUATOR

CROSS REFERENCES TO RELATED APPLICATIONS

This application is a division of application Ser. No. 600,978, filed Apr. 16, 1984, now U.S. Pat. No. 4,733,603 which is a continuation-in-part of my copending U.S. patent application Ser. No. 06/553,530 filed Nov. 21, 1983 now abandoned.

BACKGROUND OF THE INVENTION

The invention relates to an axially contractable actuator particularly suited for robotics applications.

Robotics technology is frequently presented with the problem of mimicking the function of human hands and arms. Mechanical analogies to hands and arms clearly must include some replacement for the many human muscles used to flex and move the human fingers, hands and arms. When fluid power, either hydraulic or pneumatic, is used in robotics, a fluid cylinder appears to be a likely substitute for human muscles. However, high pressure fluid requirements due to limited fluid cylinder size and space and positioning problems complicate the use of fluid cylinders or make their use impossible for some applications such as in self-propelling walking robots.

Fluid cylinders are also not entirely suitable as actuators in the food and drug industries. Restrainers must be used to contain dripping caused by leaking seals and misaligned cylinder rods.

SUMMARY OF THE INVENTION

Accoridng to the invention, an actuator has first connection means and second connection means at opposite first and second ends of the actuator and is contractable along an axis extending between the connection means. The actuator comprises at least one hollow, enclosure having an opening for admitting a pressurized fluid. A constraining means cooperates with the enclosure for converting radial expansion of the actuator into axial contraction when pressurized fluid is admitted into the enclosure.

The enclosure may be of an elastomeric material.

The constraining means may comprise a network of nonstretchable, flexible tension links.

BRIEF DESCRIPTION OF THE DRAWINGS

FIG. 11 is a perspective view of the friction reducing layer of the actuator of FIGS. 9 and 10;

FIG. 12 is a perspective view of the elastomeric enclosure of the actuator of FIGS. 9 to 11;

FIG. 13 is a sectional view along line 13-13 of FIG. 11;

DESCRIPTION OF THE PREFERRED EMBODIMENTS

Figure 1:
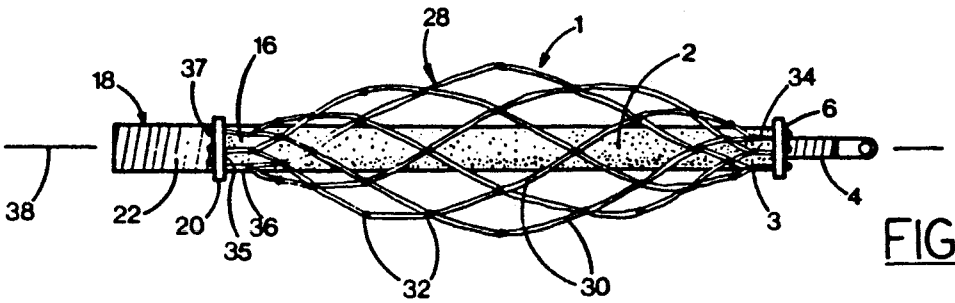
FIG. 1 is a side view of an actuator, according to an embodiment of the invention, in a pre-installation state.
Figure 2:
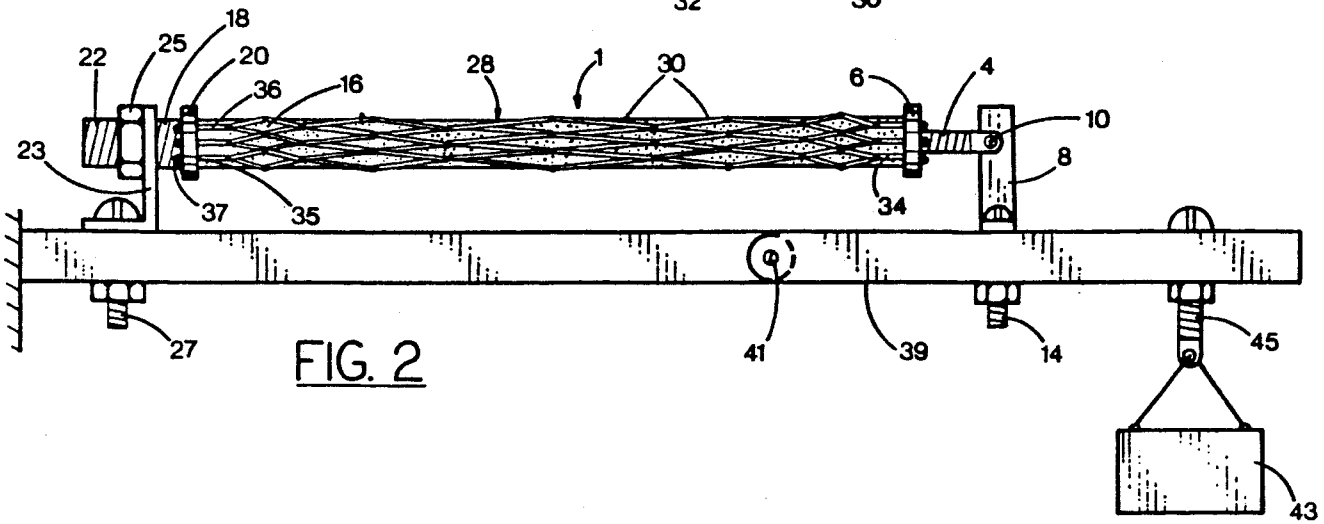
FIG. 2 is a side view of the actuator of FIG. 1 in an axially uncontracted state after installation on a hinged arm.

FIG. 1 illustrates an actuator 1 according to an embodiment of the invention. The actuator has a hollow enclosure 2, in this case of an elastomeric material. In other embodiments a plurality of enclosures could be used together in parallel. The enclosure may be made of rubber, synthetic rubber or a suitable elastomeric plastic material. The enclosure is closed at a first end 3 where it is bonded about a threaded stud or bolt 4. The stud 4 provides connection means for connecting the actuator to a mounting bracket 8 as seen in FIG. 2. The stud 4 is connected to the bracket by a pin 10. The mounting bracket is connected to an articulated arm 39 by a bolt and nut combination 14.

Figure 4:
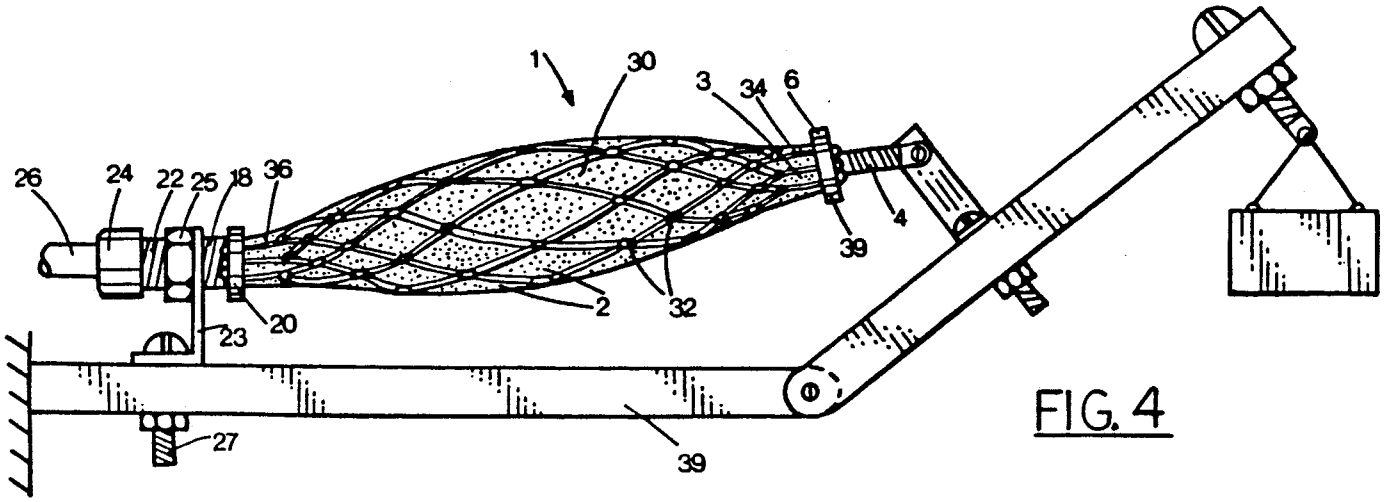
FIG. 4 is a side view of the actuator of FIGS. 1 and 2 in an axially contracted position after installation.

The enclosure has a second end 16 which is open in that it is bonded about an open ended nipple 18. The nipple has a threaded outer end 22 adapted to engage a fitting 24 of a hose 26 as shown in FIG. 4. In this manner pressurized fluid, such as hydraulic fluid or pressurized air, can be admitted into the open end of the enclosure. The nipple is connected to a bracket 23 by a nut 25 and thereby comprises a second connection means of the actuator. Bracket 23 is mounted on the arm 39 by a nut and bolt combination 27. The bracket and arm serve as an example only of means actuated by the actuator.

The actuator has a network 28 of non-stretchable, flexible tension links 30 extending about the enclosure. The links may be, for example, flexible braided wire covered with plastic. A plurality of such wires are connected together at nodes 32 to form the essentially tubular network. Alternatively the links may be of other materials such as nylon twine. The network has a first end 34. Similarly, the network has a second end 36. At end 36 the wires comprising the network pass through a plurality of apertures 35 extending through a ring 20 and extending circumferentially about the ring. The ring fits over nipple 18 and butts against end 16 of the enclosure. Knots 37 are formed on the ends of the wires to retain the ends of the wires on the ring. In a similar manner, end 34 of the network 28 is connected to ring 6 fitted over stud 4.

In referring to the actuator, axial dimensions and directions extend along longitudinal axis 38 of FIG. 1 extending between the ends of the enclosure. Transverse dimensions and directions are perpendicular to this axis.

FIG. 1 illustrates the actuator in its pre-installation or off-the-shelf condition. The enclosure 2 is unstretched and the network 28 fits loosely about the enclosure in a bag-like manner. As may be observed, there is considerable space between the network and the enclosure except at the ends 34 and 36. It may also be observed from FIGS. 1 and 4 that the network has meshes which are larger near the center of the network to fit the shape of the expanded enclosure. The meshes are progressively smaller towards the two ends of the enclosure.

FIG. 2 illustrates the actuator in an extended, initial condition. In this case, the enclosure has been axially stretched until the network fits closely about the enclosure. This is the axially uncontracted state of the actuator after installation on the arm 39 with a hinged or articulated joint 41. The initial tension required to maintain this uncontracted state is provided by a weight 43 connected to a bolt 45 on the ed of the arm.

In order to contract the actuator axially, pressurized fluid is admitted into the enclosure by hose 26 as illustrated in FIG. 4. The pressurized fluid admitted into the enclosure causes radial expansion as shown in FIG. 4 where the enclosure bulges most prominently at the midpoint between its two ends. The network acts as constraining means which is, at the same time, radially expandable, but axially contractable. The wires or other tension links comprising the network are essentially nonstretchable. Consequently the radial expansion of the network, caused by the radial expansion of the enclosure, must be accompanied by axial contraction of the actuator as may be observed by comparing FIGS. 2 and 4.

Since the entire surface area of the actuator is employed in a function analogous to a piston in a fluid cylinder, the resultant axial pulling force is several times larger than the total force exerted by the pressurized fluid acting on a piston inside a fluid cylinder of the same diameter as the actuator.

In the above embodiment there is a tendency for the network to contract axially faster than the enclosure, resulting in buckling of the enclosure near its two ends as pressurized fluid is introduced. For this reason, the network has the loose pre-installation state shown in FIG. 1. Providing the initial stretch to the enclosure upon installation, as illustrated in FIG. 2, prevents this buckling.

Figure 3:
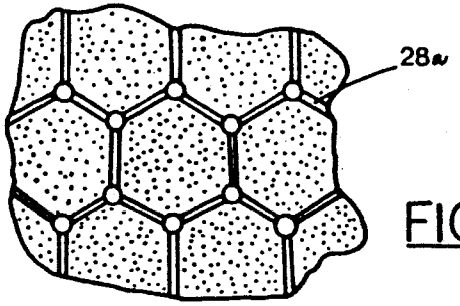
FIG. 3 is a fragmentory view of an alternative embodiment having a network with six-sided meshes.

FIGS. 1, 2 and 4 illustrate a network comprising four sided meshes. FIG. 3 illustrates an alternative embodiment wherein the network 28a has meshes with six sides when open.

The theory of operation of the actuator 1 is explained with reference to FIGS. 5 to 8. The network is represented by a line 40 of length L in FIG. 5. At one end, the line is attached to a fixed mount 42. At the opposite end, the line is attached to a load 44 slidably resting on a surface 46.

Figure 5:
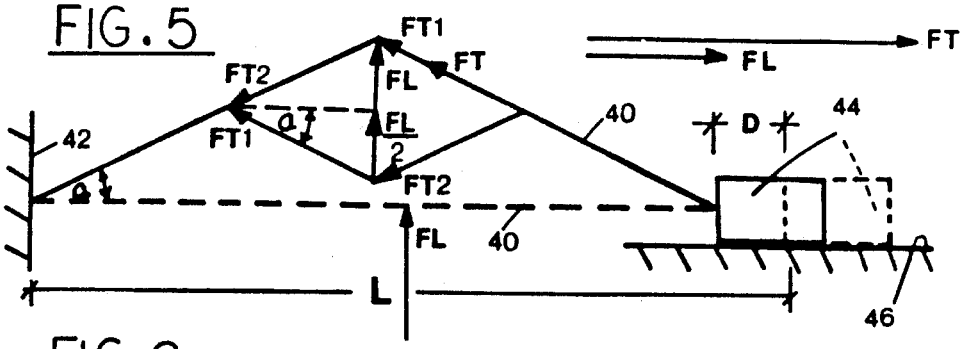
FIG. 5 is a diagrammatic side view illustrating in simplified form the function of the network of the actuator of FIGS. 1–4.

In FIG. 5, a small force FL has been applied perpendicular to the line 40. The small force FL produces a tension force FT which is many times larger than the force FL for a small angle a. At the same time, the load is moved a distance D. The relationships are defined by the following equations:

$$|FT1| = |FT2| = \frac{|FL/2|}{\sin a}$$

$$|FT| = |FT1| + |FT2| = \frac{|FL|}{\sin a}$$

and

-continued $$D = L - L \cos a$$

Figure 6:
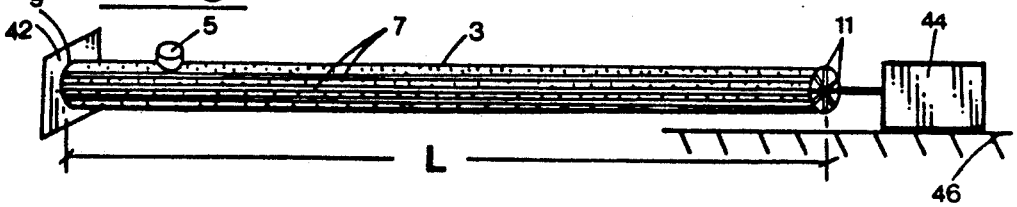
FIGS. 6 to 8 are diagrammatic perspective views illustrating in simplified form the function of the actuator of FIGS. 1–4.

FIG. 6 shows an elastomeric tube or enclosure 3 of length L. The tube is sealed at both ends, but has a port 5 for admitting a pressurized fluid. The tube is surrounded by eight non-stretchable, flexible tension links 7, only three of which can be seen from the illustrated side. At their first ends 9, the links are connected to mount 42. At their second ends 11, the links are connected to load 44 slidably resting on a surface 46.

Figure 7:
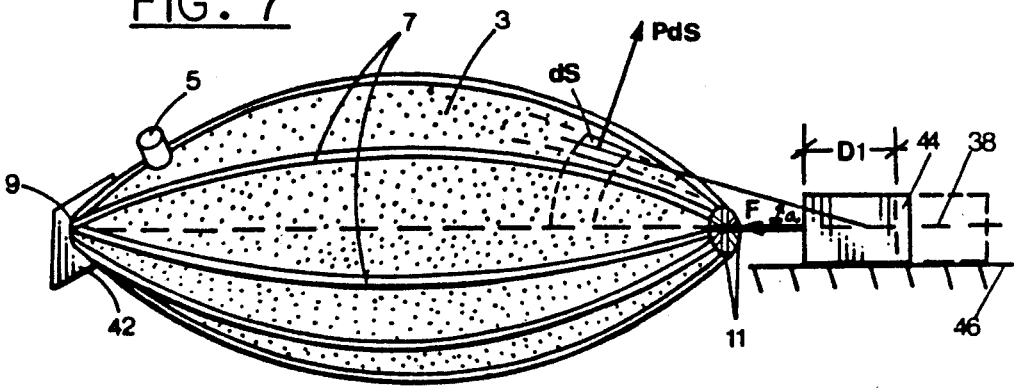

When pressurized fluid is introduced through port 5, a pulling force F is created due to radial expansion only of the enclosure surrounded by the links. Referring to FIG. 7, the load 44 has travelled a distance D1 due to the radial expansion. Distance D1 is greater than the distance D of FIG. 5. This is because the links are now deformed into the arc shape of FIG. 7 rather than the sharp bend of FIG. 5.

$$F = \int_S (PdS/\sin a)$$

where

P = pressure inside enclosure

Figure 8:
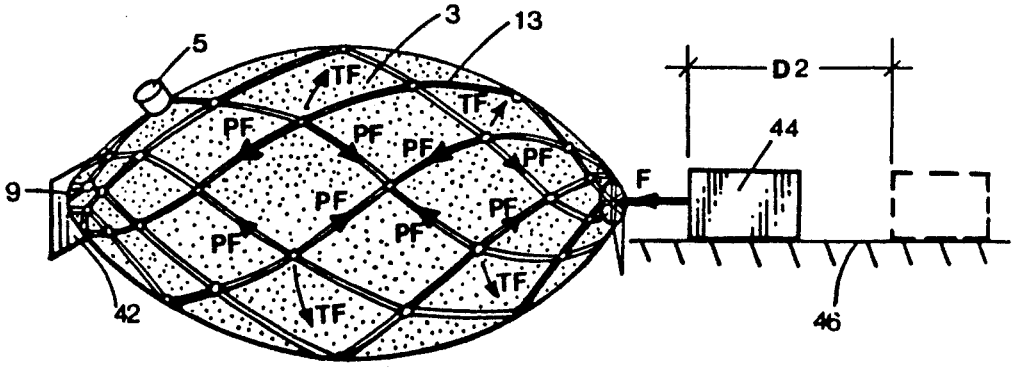

S = surface area of enclosure a = angle between centre axis 38 and tangent 41 to a point on enclosure surface If the links are interconnected at regular intervals to form a network 13, as seen in FIG. 8, and the enclosure is inflated, a two-fold application of the case of FIG. 5 occurs. Firstly, the pressurized fluid inside the enclosure provides a force along the tube's meridians as seen in FIG. 7. Secondly, tension forces TF along equators of the tube produce pulling forces PF along the links of the network.

An axially contractable actuator according to the invention offers significant advantages over hydraulic or pneumatic cylinders. The actuator is easier to manufacture and could be considerably less expensive than a cylinder. No sealing or leakage problems are likely to occur because no sliding seals are required as in the case of cylinders. Thus it would be very attractive for installation where fluid leakage is of great concern. The actuator is uneffected by side forces unlike fluid cylinders which cannot tolerate side forces. At the same time, the actuator can be installed more tightly than hydraulic cylinders, allowing more sophisticated robotic arms and hands to be designed.

FIGS. 9 to 12 illustrate an alternative actuator 1.1 which is generally similar to actuator 1. Corresponding parts are numbered the same with the additional designation "0.1".

Actuator 1.1 has an enclosure 2.1 which is spindle-shaped in the pre-installation state of FIG. 12. This allows even wall thickness after expansion of the enclosure.

Actuator 1.1 also has a network 28.1 of non-stretchable, flexible tension links 30.1 which are embedded in a layer 50 of flexible material extending about the enclosure. The layer may be of a suitable flexible plastic, for example. The layer of material is loose and bulges outwardly at meshes 52 in the pre-installation state. This permits the layer 50 to readily stretch to the uncontracted state even though the material needn't be elastomeric. This also provides a minimal resistance by the layer 50 against transverse expansion to the axially contracted state. At end 36.1 wires comprising the network are placed and bonded inside semicircular channels 35.1 extending along a cylinder 20.1. The channels are arranged circumferentially about the cylinder. The cylinder fits over a nipple 18.1 and is bonded to it. Wire 37.1 is wound about cylinder 20.1 and bonded to retain wires of the network on the cylinder. In a similar manner, end 34.1 of the network 28.1 is connected to cylinder 6.1 fitted over stud 4.1.

Actuator 1.1 also has a perforated friction reducing layer 54 in the nature of a thin resilient sheet-like tube between the layer 50 and the enclosure 2.1. Layer 54 reduces resistance to expansion caused by friction between the network 28.1 and the enclosure 2.1 in conjunction with layer 50. The perforations 80 eliminate the vacuum that may be created between layers. A suitable lubricant such as an oil, grease or petroleum jelly is applied between layer 54 and the enclosure 2.1 to further reduce friction. The lubricant may also be applied between layers 50 and 54. Layer 54 has a first end 58 and second end 59. At first end 58 it is fitted over and bonded to a first end 3.1 of elastomeric enclosure 2.1. Similarly, at second end 59 it is fitted over and bonded to second end 16.1 of the elastomeric enclosure.

Actuator 1.1 may have a longer expected life than actuator 1 due to the reduced friction and consequent reduced wear on the enclosure.

FIGS. 14–17 show an actuator 1.2 according to a further embodiment of the invention. This embodiment employs a combined enclosure and network 60. The walls 62 are of an elastomeric material, such as rubber and serve as the enclosure. A network 63 of non-stretchable, flexible links 64, such as braided wire, are embedded in walls 62. A second network 66 of similar or lighter wire, for example, extends across each of the meshes 68 of the network 63. This second network stops undue outward bulging of enclosure 62 between the wires of network 63.

The actuator 1.2 is similar to previous embodiments, having a port 70 for connecting a hose for supplying a pressurized fluid. Rings 74 and 76 provide connection means at opposite ends of the actuator. Wires or links 64 extend about the rings for added strength as may be seen in FIG. 17. Rings 74 and 76 and links 64 are encapsulated in suitable rigid plastic bodies 75 and 77 at each end of the actuator.

Figure 9:
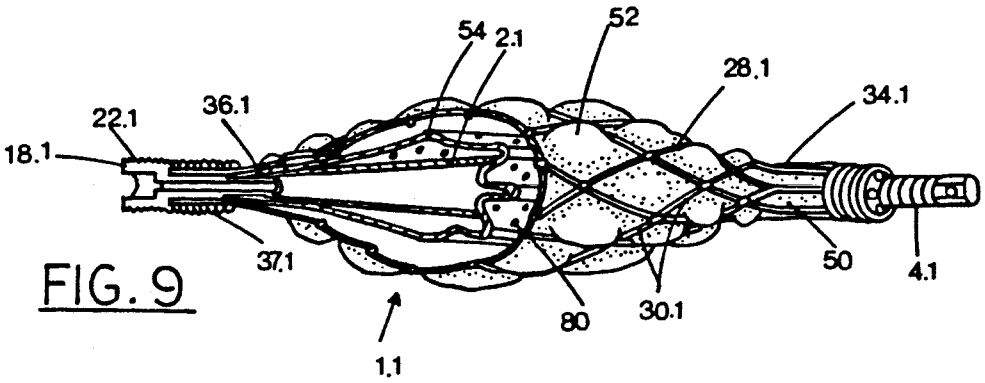
FIG. 9 is a perspective view, partly broken away, of an actuator according to another embodiment of the invention.
Figure 10:
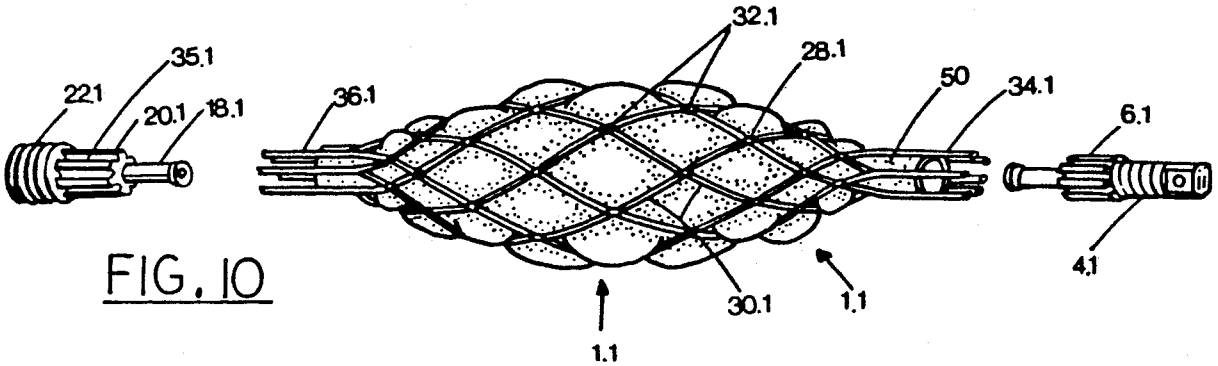
FIG. 10 is an exploded perspective view of the actuator of FIG. 9.
Figure 14:
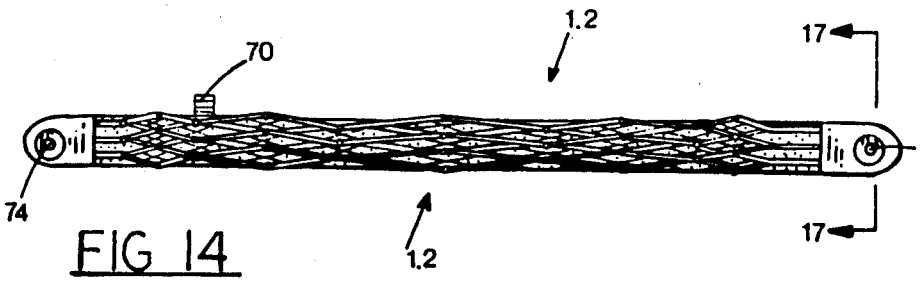
FIG. 14 is a side view of an actuator according to a further embodiment of the invention in an axially uncontracted state.
Figure 15:
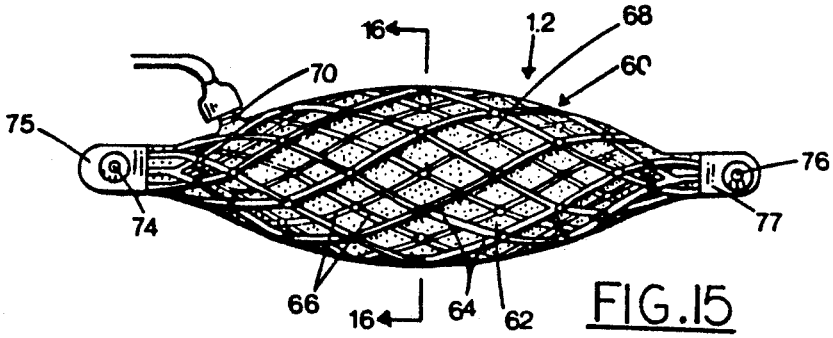
FIG. 15 is a side view of the actuator of FIG. 13 in an axially contracted state.
Figure 16:
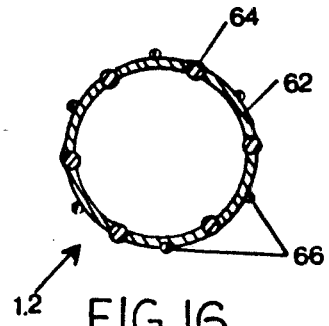
FIG. 16 is a sectional view along line 16-16 of FIG. 15.
Figure 17:
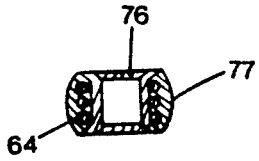
FIG. 17 is a sectional view along line 17-17 of FIG. 14.

Although an elastomeric material is preferred for the enclosure, other sheet-like, flexible, non-permeable materials of plastic, for example, can be used. Referring to FIG. 9, the entire actuator may comprise the network 28.1 embedded in the non-elastomeric layer 50 which serves as the enclosure. The connecting means could be of either the form shown in FIG. 9 or the form shown in FIG. 14. The material is oversized and tends to bulge outwardly between the links of the network. This accommodates the necessary expansion and distortion of the enclosure without the need of elastomeric qualities.

What is claimed is:

1. The method of assembling an axially contractable actuator, comprising the steps of:

(a) providing an impermeable expansible enclosure having an axis and means for introducing and withdrawing pressurized fluid for thereby causing expansion and contraction thereof along the axis and the enclosure further having means for connection to an article;

(b) providing an axially deformable network-shaped structure having a plurality of open areas and each open area defined by a plurality of non-extensible pivotally interconnected side members and the side members being axially parallel in the elongated state and disposed at a substantial angle to the axis in the contracted state;

(c) enveloping the enclosure with the structure so that contraction of the enclosure causes the structure to assume the contracted state and portions of the enclosure to thereby bulge through the open areas and expansion of the enclosure causes the structure to assume the elongated state.

2. The method of claim 1, including the step of:

(a) forming the enclosure of elastomeric material.

3. The method of claim 1, including the step of:

(a) providing a structure comprising filamentary links as the side members.

4. The method of claim 3, including the step of:

(a) interconnecting the links so that each open area is defined by at least four links.

5. The method of claim 4, including the step of:

(a) interconnecting the links so that the open areas nearest the ends of the structure have an area less than the area of the open areas remote therefrom.

6. The method of claim 1, including the step of:

(a) enveloping the structure about the enclosure by embedding the structure therein.

7. The method of claim 1, including the step of:

(a) enveloping the structure and enclosure with a friction reducing layer.

8. The method of claim 7, including the step of:

(a) providing a perforated sheet as the friction reducing layer.

9. The method of claim 7, including the step of:

(a) providing a lubricant between the friction reducing layer and the enclosure.

10. The method of claim 1, including the step of:

(a) providing an enclosure formed of non-elastomeric material.

11. The method of moving an article, comprising the steps of:

(a) providing a support;

(b) providing an axially contractable actuator comprising an enclosure having means for introducing and withdrawing pressurized fluid for causing contraction and expansion of the enclosure and the enclosure enveloped by an axially deformable network-shaped structure having a plurality of open areas and each open area defined by a plurality of pivotally interconnected side members and the side members being axially parallel when the enclosure is in the elongated state and at a substantial angle to the axis when the enclosure is in the contracted state and portions of the enclosure bulging through the open areas when the enclosure is in the contracted state and a first end portion of the actuator includes means for operable connection to an article;

(c) connecting a second end portion of the actuator to the support;

(d) operably connecting an article to the first end portion; and, (e) introducing or withdrawing pressurized fluid into the enclosure and thereby causing contraction or expansion of the enclosure and associated movement of the article.

12. The method of claim 11, including the steps of:

(a) providing an articulated support having a first fixed portion and a second portion pivotally connected thereto;

(b) connecting the actuator first end portion to the second portion and the second end portion to the support first portion; and, (c) connecting the article to the support second portion.

13. The method of claim 12, including the steps of:

(a) positioning the support first portion in horizontal relation; and, (b) positioning the support second portion in horizontal relation when the enclosure is in the expanded state.

14. The method of claim 13, including the steps of:

(a) connecting a first vertical extension to the support first portion;

(b) connecting a second vertical extension to the support second portion; and, (c) connecting the actuator first end portion to the second extension and the second end portion to the first extension so that the actuator extends parallel to the support when the enclosure is elongated.

15. The method of claim 11, including the step of:

(a) enveloping the structure about the enclosure by embedding the structure therein.

16. The method of claim 11, including the step of:

(a) providing an enclosure comprised of elastomeric material.

17. The method of claim 11, including the step of:

(a) providing an enclosure comprised of non-elastomeric material.

18. The method of claim 11, including the step of:

(a) providing a structure wherein the open areas at the ends thereof have an area less than the area of the open areas remote therefrom.

* * * * *